US010439328B2

(12) United States Patent
Babezki et al.

(10) Patent No.: US 10,439,328 B2
(45) Date of Patent: Oct. 8, 2019

(54) PLUG CONNECTOR PART HAVING A COMPENSATION DEVICE

(71) Applicant: Phoenix Contact E-Mobility GmbH, Schieder-Schwalenberg (DE)

(72) Inventors: Robert Babezki, Steinheim (DE); Thomas Fuehrer, Blomberg (DE)

(73) Assignee: PHOENIX CONTACT E-MOBILITY GMBH, Schieder-Schwalenberg (DE)

( * ) Notice: Subject to any disclaimer, the term of this patent is extended or adjusted under 35 U.S.C. 154(b) by 79 days.

(21) Appl. No.: 15/542,943

(22) PCT Filed: Jan. 12, 2016

(86) PCT No.: PCT/EP2016/050434
§ 371 (c)(1),
(2) Date: Jul. 12, 2017

(87) PCT Pub. No.: WO2016/113238
PCT Pub. Date: Jul. 21, 2016

(65) Prior Publication Data

US 2018/0269631 A1 Sep. 20, 2018

(30) Foreign Application Priority Data

Jan. 14, 2015 (DE) ..... 10 2015 100 452

(51) Int. Cl.
*H01R 13/64* (2006.01)
*H01R 13/631* (2006.01)
(Continued)

(52) U.S. Cl.
CPC ..... *H01R 13/64* (2013.01); *H01R 13/6315* (2013.01); *H01R 13/71* (2013.01); *H01R 31/06* (2013.01); *H01R 2201/26* (2013.01)

(58) Field of Classification Search
CPC ..... H01R 13/631; H01R 13/62
(Continued)

(56) References Cited

U.S. PATENT DOCUMENTS 3,609,637 A * 9/1971 Cole ..... H01R 13/627 439/349
4,030,797 A 6/1977 Nieman
(Continued)

FOREIGN PATENT DOCUMENTS

DE 69208628 T2 8/1996
DE 102010035868 B3 2/2012
(Continued)

*Primary Examiner* — Abdullah A Riyami
*Assistant Examiner* — Thang H Nguyen
(74) *Attorney, Agent, or Firm* — Leydig, Voit & Mayer, Ltd.

(57) ABSTRACT

A plug connector part includes a plug housing that has at least one plug-in portion that can be connected to a mating plug connector part by plugging in an insertion direction so as to contact the plug connector part electrically with the mating plug connector part; and a compensation device arranged on the plug housing, the compensation device including: a housing; a carrier element connected to the plug housing and arranged on the housing; and a spring element that biases the carrier element with respect to the housing, wherein the carrier element is movable relative to the housing by way of resilient deformation of the spring element.

17 Claims, 8 Drawing Sheets

(51) Int. Cl.
*H01R 13/71* (2006.01)
*H01R 31/06* (2006.01)

(58) Field of Classification Search
USPC ..... 439/246, 247, 248
See application file for complete search history.

(56) References Cited

U.S. PATENT DOCUMENTS

| | | | | |
|---|---|---|---|---|
| 4,815,986 | A | 3/1989 | Dholoo | |
| 5,147,221 | A * | 9/1992 | Cull | H01R 24/40 439/585 |
| 6,390,841 | B1 | 5/2002 | Zaguskin | |
| 2007/0190841 | A1* | 8/2007 | Van Der Steen | G02B 6/3817 439/247 |
| 2010/0330835 | A1* | 12/2010 | Rudolph | H01R 13/627 439/357 |
| 2013/0252458 | A1 | 9/2013 | Krome et al. | |
| 2015/0303620 | A1* | 10/2015 | Friesen | H01R 13/627 439/345 |
| 2017/0288341 | A1* | 10/2017 | Tuenker | H01R 13/6456 |

FOREIGN PATENT DOCUMENTS

| | | | | |
|---|---|---|---|---|
| FR | 2756428 | A1 | 5/1998 | |
| GB | 2360642 | A | 9/2001 | |
| GB | 2373378 | A * | 9/2002 | H01R 13/629 |
| GB | 2373378 | A | 9/2002 | |

* cited by examiner

PLUG CONNECTOR PART HAVING A COMPENSATION DEVICE

CROSS-REFERENCE TO PRIOR APPLICATIONS

This application is a U.S. National Phase application under 35 U.S.C. § 371 of International Application No. PCT/EP2016/050434, filed on Jan. 12, 2016, and claims benefit to German Patent Application No. DE 10 2015 100 452.6, filed on Jan. 14, 2015. The International Application was published in German on Jul. 21, 2016 as WO 2016/113238 A1 under PCT Article 21(2).

FIELD

The invention relates to a plug connector part having a plug housing with a plug-in portion for connecting to a mating plug connector part.

BACKGROUND

A plug connector part of this type comprises a plug housing that has at least one plug-in portion that can be connected to a mating plug connector part by plugging in an insertion direction so as to contact the plug connector part electrically with the mating plug connector part.

A plug connector part of this type may for example be formed as a charging plug for electrically charging a battery of an electric vehicle. In this case, the plug connector part may for example be connected via an electrical supply line to a charging station and be intended for insertion into a charging socket of an electric vehicle, in such a way that, when the plug connector part is connected up, charging currents can be transmitted from the charging station to the electric vehicle so as thus to charge the battery of the electric vehicle.

To charge electric vehicles, fully automatic or semi-automatic charging devices are increasingly being made use of nowadays. In charging devices of this type, the plug connector part is not plugged manually to an associated mating plug connector part (at the electric vehicle), but instead the plug connector part is brought toward the mating plug connector part automatically using an electromechanical assembly and is brought into engagement with the mating plug connector part by plugging.

These fully automatic or semi-automatic charging devices require the position of the mating plug connector part on the vehicle to be detected with sufficient precision, for example using an optical sensor system, in such a way that the plug connector part can automatically be brought toward the mating plug connector part and be brought into engagement with the mating plug connector part. Position detection of this type, however, is only possible with limited precision. In addition, axis detection for placing the plug connector part on the associated mating plug connector part in an axially parallel manner is difficult. However, if the axes of the plug connector part and the mating plug connector part deviate from one another when a plug connector part is placed on an associated mating plug connector part, this can lead to contacts of the plug connector part and of the mating plug connector part being placed on another with a lateral offset or even with an angular offset, and this can lead to tilting of the plug connector part on the mating plug connector part and thus to considerable strains on the plug connector part and on the mating plug connector part, and in particular even on the electrical contacts thereof.

Strains of this type may also occur if there is a change in position of the vehicle relative to the charging station during a charging process, which may be accompanied by a change in position of the plug connector part relative to the mating plug connector part. Changes in position of this type may for example occur when the vehicle is loaded and unloaded and the vehicle rises or falls as a result.

There is thus a need for a plug connector part that makes positional and angular deviations relative to a mating plug connector part possible to some extent but at the same time can securely and reliably be brought into engagement with an associated mating plug connector part for electrical contacting.

In a plug connector part known from DE 10 2010 035 868 B3, plug contacts are received in a floating manner on a contact carrier. In addition, the contact carrier is arranged in a floating manner on a housing, in such a way that positional and angular deviations can be compensated during plugged connection to a mating plug connector part.

SUMMARY

In an embodiment, the present invention provides a plug connector part, comprising: a plug housing that has at least one plug-in portion configured to be connected to a mating plug connector part by plugging in an insertion direction so as to contact the plug connector part electrically with the mating plug connector part; and a compensation device arranged on the plug housing, the compensation device comprising: a housing; a carrier element connected to the plug housing and arranged on the housing; and a spring element that biases the carrier element with respect to the housing, wherein the carrier element is movable relative to the housing by way of resilient deformation of the spring element.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
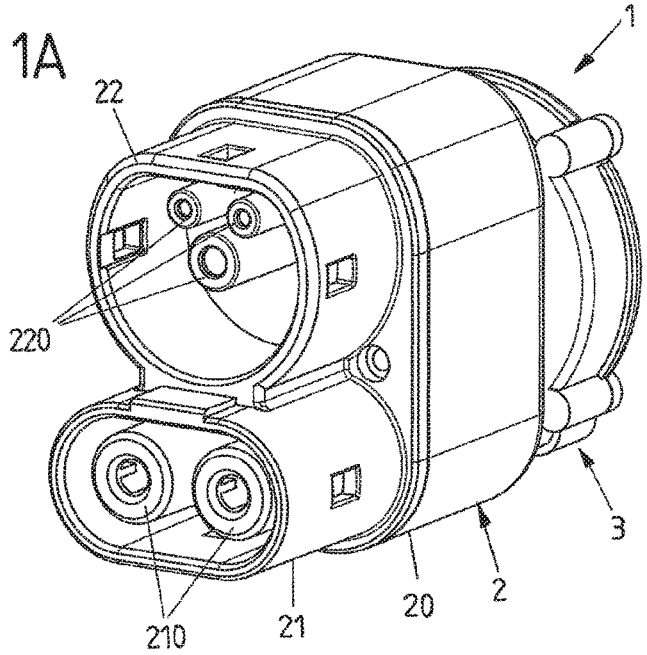
FIG. 1A is a perspective view of a plug connector part.

In an embodiment, the present invention provides a plug connector part comprising a compensation device that is arranged on the plug housing and that comprises a housing, a carrier element connected to the plug housing and arranged on the housing, and a spring element that biases the carrier element with respect to the housing, the carrier element being movable relative to the housing by way of resilient deformation of the spring element.

The plug connector part thus comprises a plug housing and a compensation device arranged on the plug housing. The plug housing is for plugged connection to an associated mating plug connector part, and for this purpose comprises one or more plug-in portions on which for example electrical contacts for electrically contacting associated mating contacts at the mating plug connector part may be arranged. By contrast, the compensation device serves to compensate deviations in the position and/or angle at which the plug connector part is placed on the associated mating plug connector part from a target position and a target angle. Generally, the plug housing of the plug connector part is to be placed on the mating plug connector part in an insertion direction, this (only) being possible in a defined (target) position at a defined (target) angle, specifically flush with the mating plug connector part. If there are deviations from this target position and this target angle when the plug connector part is placed on the mating plug connector part, these deviations can be compensated by the compensation device.

This takes place by way of resilient deformation of the spring element that biases the carried element arranged on the housing with respect to the housing. For example, a suitable holding device, by way of which the plug connector part can be moved and brought toward the mating plug connector part electromechanically, may be connected to the housing. By contrast, the plug housing of the plug connector part can be connected to the carrier element. If there are deviations from the target position or the target angle when the plug housing is placed on the mating plug connector part, the carrier element connected to the plug housing can move relative to the housing in such a way that deviations of this type can be compensated and no tilting of the plug housing along with the mating plug connector part occurs and the strains in particular on the electrical contacts of the plug connector part and mating plug connector part are reduced.

The carrier element may for example be arranged with a disc-shaped base portion inside an interior of the housing of the compensation device, and thus be enclosed by the housing. In this case, for example a stud element may extend toward the plug housing from the base portion, said stud element passing through an opening in the housing of the compensation device and being connected, at an end remote from the base portion of the carrier element, to the plug housing. By way of the base portion, the carrier element is thus held inside the housing of the compensation device, and is thus biased with respect to the housing by way of the spring element. If the position of the plug housing relative to the housing of the compensation device changes, the base portion of the carrier element moves inside the housing, this being accompanied by a deformation of the spring element inside the housing.

To make it possible for the base portion of the carrier element to move inside the housing, the opening in the housing through which the stud element of the carrier element passes is preferably larger than the lateral dimensions of the stud element, in such a way that the stud element can move transverse to the insertion direction inside the opening.

The carrier element is preferably fixed rotationally engaged on the spring element. The carrier element is thus held in a defined position on the spring element and positioned in the housing by way of the spring element. As a result of the spring element biasing the carrier element with respect to the housing, the carrier element is held in a substantially undeflected position relative to the housing when the plug connector part is not engaged with an associated mating plug connector part.

The housing may for example be made in two pieces from two housing parts that are to be placed on one another. For example, a dome protruding into the interior of the housing in the insertion direction is formed on one of these housing parts, and serves to act on the carrier element when the plug connector part is placed on an associated mating plug connector part, so as to transmit to the carrier element, and thereby to the plug housing, sufficient plugging forces for plugged connection to the mating plug connector part.

In this context, in an undeflected position the dome is preferably spaced apart from the carrier element and thus not in contact with the carrier element. If the plug connector part is placed on an associated mating plug connector part, the spring element is compressed axially in the insertion direction, and this results in the dome coming into contact with a bearing face of the carrier element and thus in the possibility of introducing axial forces into the carrier element. A holding device that is connected to the housing of the compensation device and introduces plugging forces into the housing of the compensation device can thus press axially on the carrier element when the dome is in contact with the bearing face of the carrier element, and thus bring the plug housing connected to the carrier element into engagement with the associated mating plug connector part.

In an advantageous embodiment, the dome comprises a contact face that is formed in the shape of a spherical cap and is to be brought into contact with the bearing face of the carrier element. If the bearing face of the carrier element is also in the shape of a spherical cap, the dome and the bearing face of the carrier element together form a sliding bearing that makes it possible for the carrier element to pivot relative to the housing with sliding guidance of the dome positioned on the carrier element.

In this context, it may be advantageous for the bearing face of the carrier element and the contact face of the dome, which are both formed in the shape of a spherical cap, to have different radii. If the radius of the spherical-cap-shaped contact face of the dome is less than the radius of the spherical-cap-shaped bearing face of the carrier element, the dome and the carrier element can pivot with respect to one another and additionally also be offset laterally (transverse to the insertion direction) with respect to one another, in such a way that, favorably, positional and angular deviations when the dome of the housing is placed on the bearing face of the carrier element and thus during axial force transmission from the housing of the compensation device to the plug housing can be compensated.

The spring element may for example be made of plastics material, for example a highly resilient elastomer. The spring element may for example have an annular base shape and extend around the insertion direction in the interior of the housing of the compensation device. By way of the spring element, the carrier element may in particular be biased counter to the insertion direction and transverse to the insertion direction with respect to the housing, in such a way that the carrier element can be brought counter to the insertion direction axially toward the dome protruding in the insertion direction from a base of the housing and can additionally be offset laterally (transverse to the insertion direction) in the housing by way of deformation of the spring element.

The carrier element is preferably held on the spring element in a positive fit. For this purpose, the spring element may for example comprise a receiving portion, which is formed annular and on which for example the base portion of the carrier element may be placed. In this case, for example a plurality of spring portions may extend from this receiving portion in the manner of spring lips, these spring portions for example extending from the receiving portion radially with respect to the insertion direction and axially along the insertion direction, and thus establishing a resilient connection between the carrier element and the housing of the compensation device.

In a first embodiment, the spring portions may for example extend annularly around the receiving portion.

In a second embodiment, however, it is also conceivable and possible for the spring portions to be interrupted in the peripheral direction around the insertion direction in the manner of segments, and thus not to form closed rings.

Figure 1B:
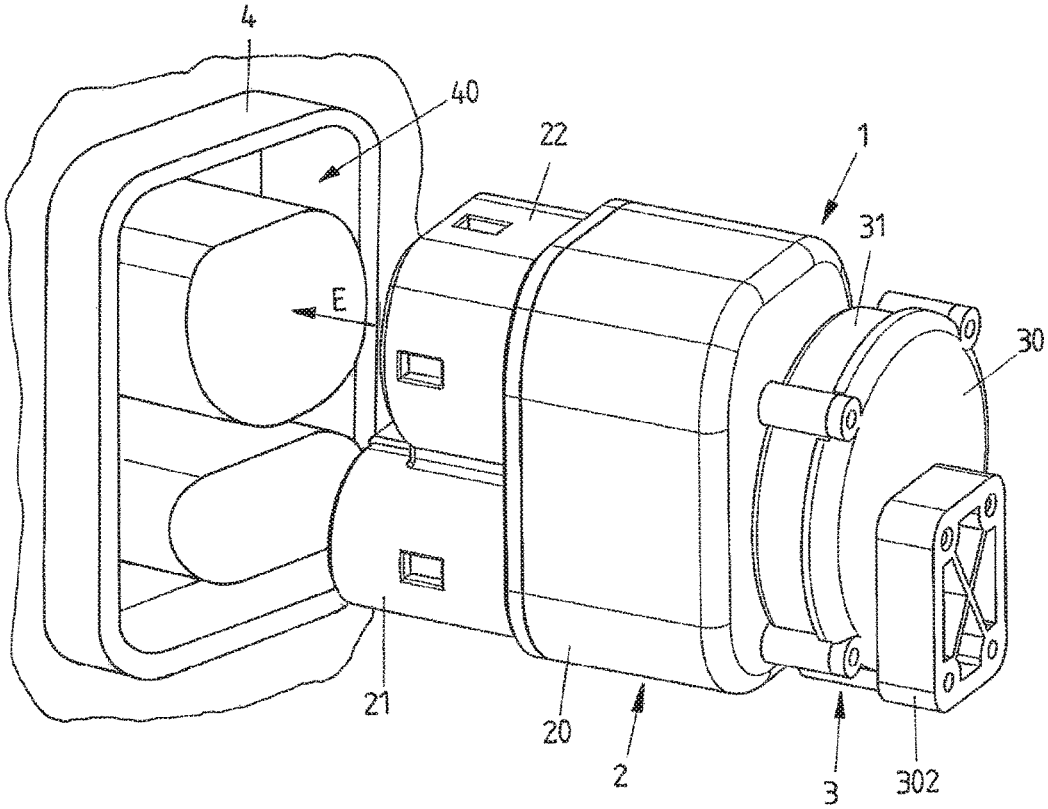
FIG. 1B is another perspective view of the plug connector part, together with a mating plug connector part with which the plug connector part is to be brought into engagement in an insertion direction.

FIG. 1A, 1B show an embodiment of a plug connector part 1, which, as is shown schematically in FIG. 1B, can be brought into engagement with an associated mating plug connector part 4 by plugging in an insertion direction E. The plug connector part 1 may for example be part of a charging device and thus be formed as a charging plug that can be brought into engagement with an associated mating plug connector part 4 in the form of a charging socket by plugging so as to transmit charging currents for example between a charging station and an electric vehicle to charge batteries of the electric vehicle.

The plug connector part 1 comprises a plug housing 2 having a housing portion 20 from which plug-in portions 21, 22 protrude in the insertion direction E. The plug-in portions 21, 22 can be inserted into an insertion opening 40 in the mating plug connector part 4 in the insertion direction E so as thus to contact electrical contact elements 210, 220 arranged on the plug-in portions 21, 22 electrically with associated mating contact elements of the mating plug connector part 4.

To the rear of the plug-in portions 21, 22, the plug housing 2 is connected to a compensation device 3, which serves to compensate positional deviations and angular deviations when the plug connector part 1 is placed on the mating plug connector part 4 and thus to prevent tilting of the plug-in portions 21, 22 of the plug connector part 1 in the insertion opening 40 in the mating plug connector part 4 and reduce strains in particular on the contact elements 210, 220.

As is shown schematically in FIG. 9, an electromechanical holding device 5, which is connected to a housing 30, 31 of the compensation device 3 via a connecting element 302 and serves to place the plug connector part 1 on the mating plug connector part 4 and bring it into engagement therewith in an automatic, controlled manner, may act on the compensation device 3.

Figure 2A:
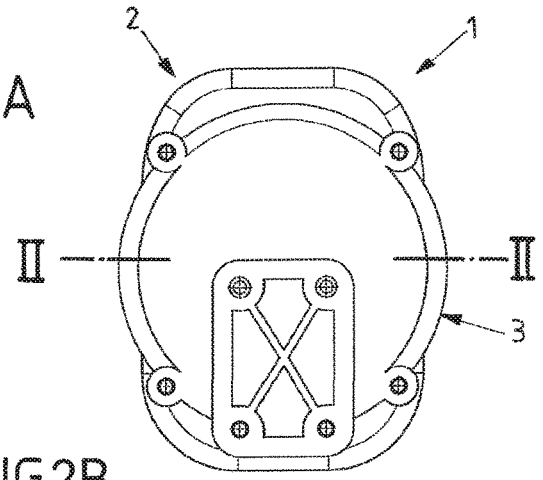
FIG. 2A is a view of the plug connector part from behind.
Figure 2B:
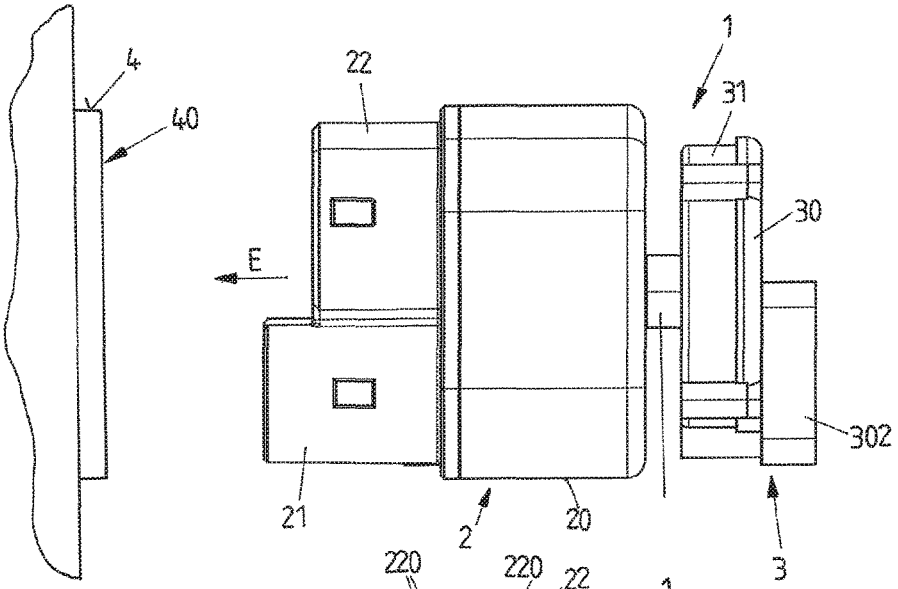
FIG. 2B is a side view of the plug connector part.
Figure 2C:
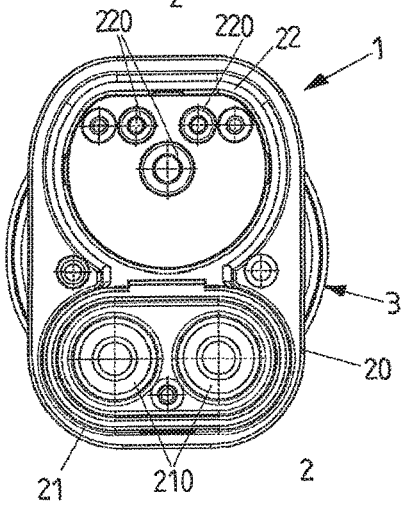
FIG. 2C is a view of the plug connector part from the front.

FIG. 2A to 2C are a rear view (FIG. 2A), a side view (FIG. 2B) and a front view (FIG. 2C) of the plug connector part 1. As can be seen in particular from FIG. 2B, the compensation device 3 is connected to the housing portion 20 of the plug housing 2 via a stud element 332 of a carrier element (which is to be described in greater detail below), the position of the stud element 332 and thus of the plug housing 2 relative to the housing 30, 31 of the compensation device 31 can be varied, and in this way deviations from a target position and a target angle can be compensated when the plug connector part 1 is placed on an associated mating plug connector part 4.

Figure 3A:
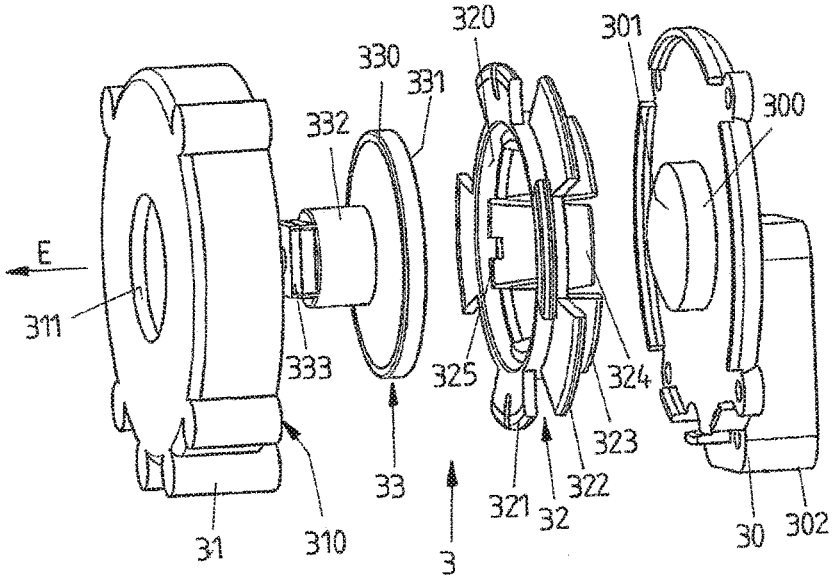
FIG. 3A is a perspective exploded view of a compensation device of the plug connector part.
Figure 3B:
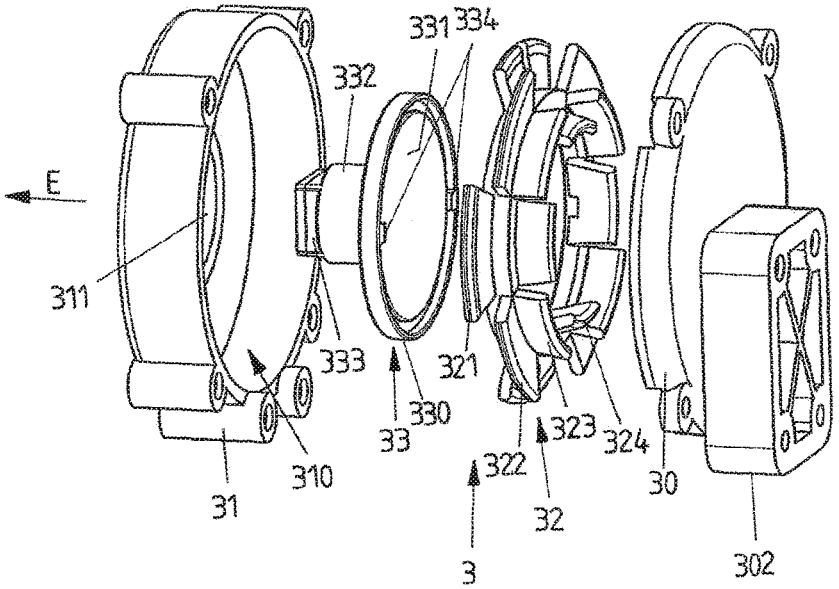
FIG. 3B is another perspective view of the compensation device.
Figure 4:
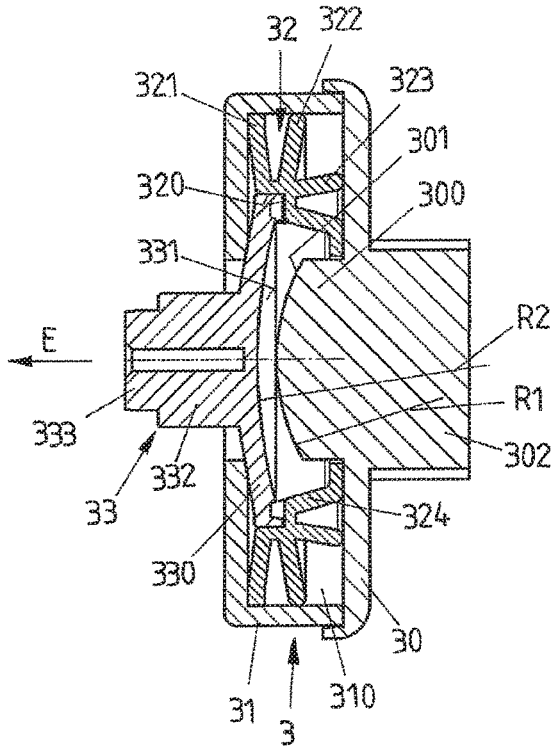
FIG. 4 is a sectional view through the compensation device of FIG. 3A, 3B.

FIG. 3A, 3B are perspective exploded views of the compensation device 3, whilst FIG. 4 is a sectional view of the compensation device 3 along the line II-II of FIG. 2A. The compensation device 3 comprises a housing formed by housing parts 30, 31 that enclose an interior 310 when assembled. In this context, a first housing part 30 carries the connecting element 302 for connection to an (external) holding device 5, which is shown schematically in FIG. 9. A second housing part 31 faces the plug housing 2 and is rigidly connected to the first housing part 30 when mounted.

A spring element 32 is arranged in the interior 310 of the housing 30, 31, is connected to a base portion 330 of a carrier element 33, and biases the carrier element 33 with respect to the housing 30, 31. The spring element 32 comprises an annular receiving portion 320, into which the base portion 330 of the carrier element 33 is inserted, positive-fit elements 334 in the form of protrusions on the base portion 330 of the carrier element 33 engaging in positive-fit elements 325 in the form of recesses on the receiving portion 320 of the spring element 32 and thus fixing the carrier element 33 rotationally engaged on the spring element 32.

A stud element 332 protrudes from the base portion 330 of the carrier element 33 on a face remote from the spring element 32, said stud element passing through an opening 311 on the second housing part 31 and being rigidly connected to the housing portion 20 of the plug housing 2 via a connecting portion 333.

A dome 300 is formed internally on the first housing part 30 and protrudes from the housing part 30 toward the carrier element 33 in the insertion direction. On a face facing the carrier element 33, the dome 300 comprises a contact face 301 having a spherical cap shape, which is positioned opposite a likewise spherical-cap-shaped bearing face 331 on a face of the carrier element 33 facing the dome 300, and is formed to come into contact with the bearing face 331 when the plug connector part 1 is inserted into the mating plug connector part 4.

As can be seen from the sectional view of FIG. 4, in an undeflected initial position the carrier element 33 is held biased in the interior 310 between the housing parts 30, 31 by way of the spring element 32. In this initial position, the contact face 301 of the dome 300 is spaced apart from the bearing face 331 axially along the insertion direction E, in such a way that the dome 300 is not in contact with the carrier element 33.

As can also be seen from the sectional view of FIG. 4, the spherical-cap-shaped contact face 301 of the dome 300 and the spherical-cap-shaped bearing face 331 of the carrier element 33 have different radii R1, R2. The radius R1 of the contact face 301 is in this case smaller than the radius R2 of the bearing face 331. This makes it possible, as is to be described in greater detail in the following, for the carrier element 33 to pivot relative to the dome 300 inside the housing 30, 31 and additionally to be displaced laterally, transverse to the insertion direction E.

The spring element 32 is formed resilient and is for example made of a plastics material, in particular an elastomer. Different embodiments of the spring element 32 are conceivable and possible.

Figure 5A:
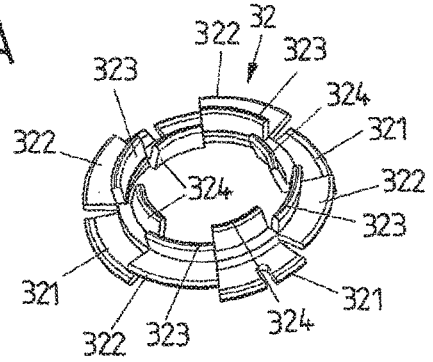
FIG. 5A, 5B are views of a first embodiment of a spring element of the compensation device.
Figure 5B:
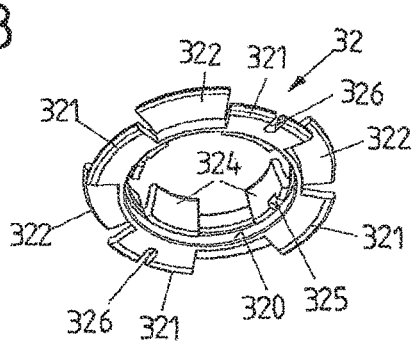
Figure 6A:
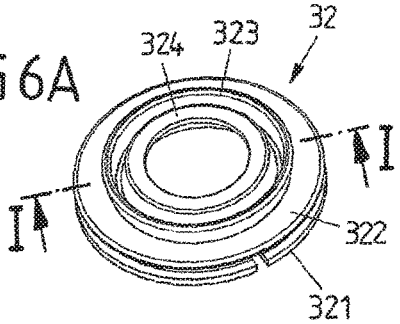
FIG. 6A, 6B are perspective views of a second embodiment of a spring element.
Figure 6D:
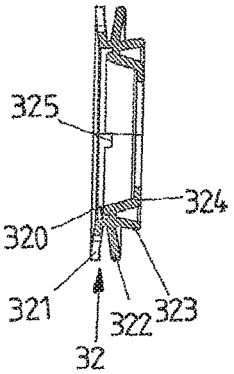
FIG. 6D is a sectional view along the line I-I of FIG. 6A.
Figure 6C:
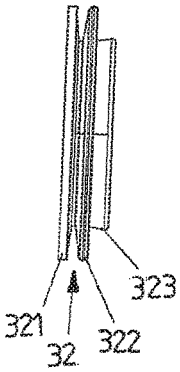
FIG. 6C is a side view of the embodiment of the spring element according to FIG. 6A, 6B.
Figure 6B:
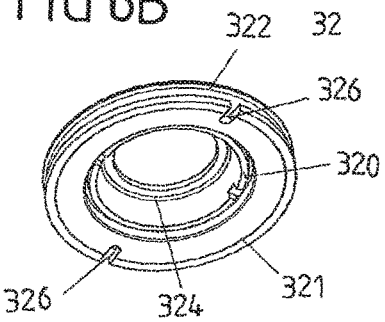

In a first embodiment, shown in FIG. 5A, 5B, the spring element has an annular base shape, in which segmented spring portions 321-324 extend from the annular receiving portion 320 in the manner of lugs. The spring portions 321-324 extend radially with respect to the insertion direction E (spring portions 321, 322) or axially with respect to the insertion direction E (spring portions 323, 324). By way of the spring portions 321-324, the spring element 32 is held inside the housing 30, 31 of the compensation device 3 in that the spring portions 321-324 are in contact with the peripheral housing walls of the housing 30, 31.

By way of recesses 326 in two of the spring portions 321, the spring element 32 can additionally be fixed in a positive fit inside the housing 30, 31 and thus be held rotationally engaged about the insertion direction E in the housing 30, 31.

In another embodiment, shown in FIG. 6A-6D, the spring element 32 is configured with annular spring portions 321-324, which peripherally enclose the annular receiving portion 320 and are closed in the peripheral direction about the insertion direction E. In turn, the spring portions 321-324 extend substantially radially with respect to the insertion direction E (spring portions 321, 322) or axially with respect to the insertion direction E (spring portions 323, 324).

The spring element 32 in accordance with the embodiment of FIG. 6A-6D may also be fixed inside the housing 30, 31 of the compensation device 3 in a positive fit by way of recesses 326 in the spring portion 321, and thus be held rotationally engaged in the housing 30, 31.

As stated, the compensation device 3 serves to compensate deviations from a target position and a target angle when the plug connector part 1 is placed on an associated mating plug connector part 4. How this takes place is illustrated in the sectional views of FIG. 7A to 7E.

In an initial position, before the plug connector part 1 is placed on the associated mating plug connector part 4, the stud element 332 of the carrier element 33 is located in an approximately central position at the opening 311 in the housing part 31 of the compensation device 3. By way of the spring element 32, the carrier element 33 and thereby the plug housing 2 rigidly connected to the carrier element 33 are held in position with respect to the housing 30, 31 of the compensation device 3, in such a way that longitudinal axes L (corresponding to the axes of rotational symmetry) of the carrier element 33 and of the dome 300 are flush.

Figure 7A:
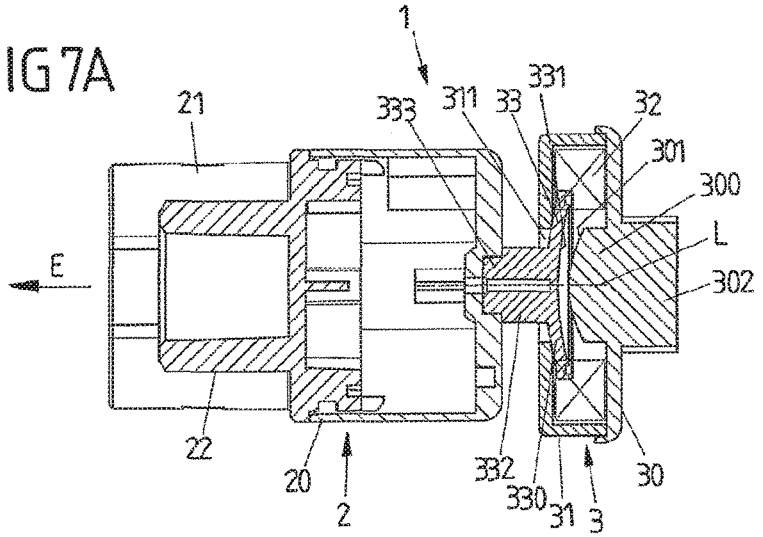
FIG. 7A-7E are sectional views along the line II-II of FIG. 2A, in different positions of the compensation device relative to a plug housing of the plug connector part.
Figure 7B:
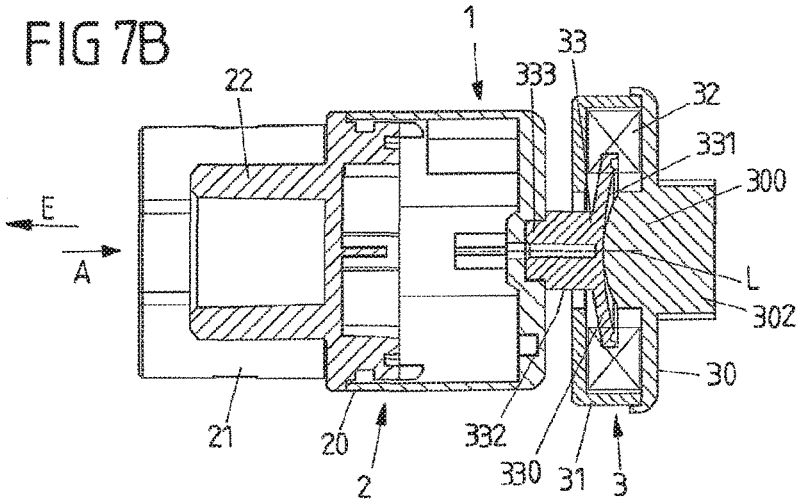
Figure 8:
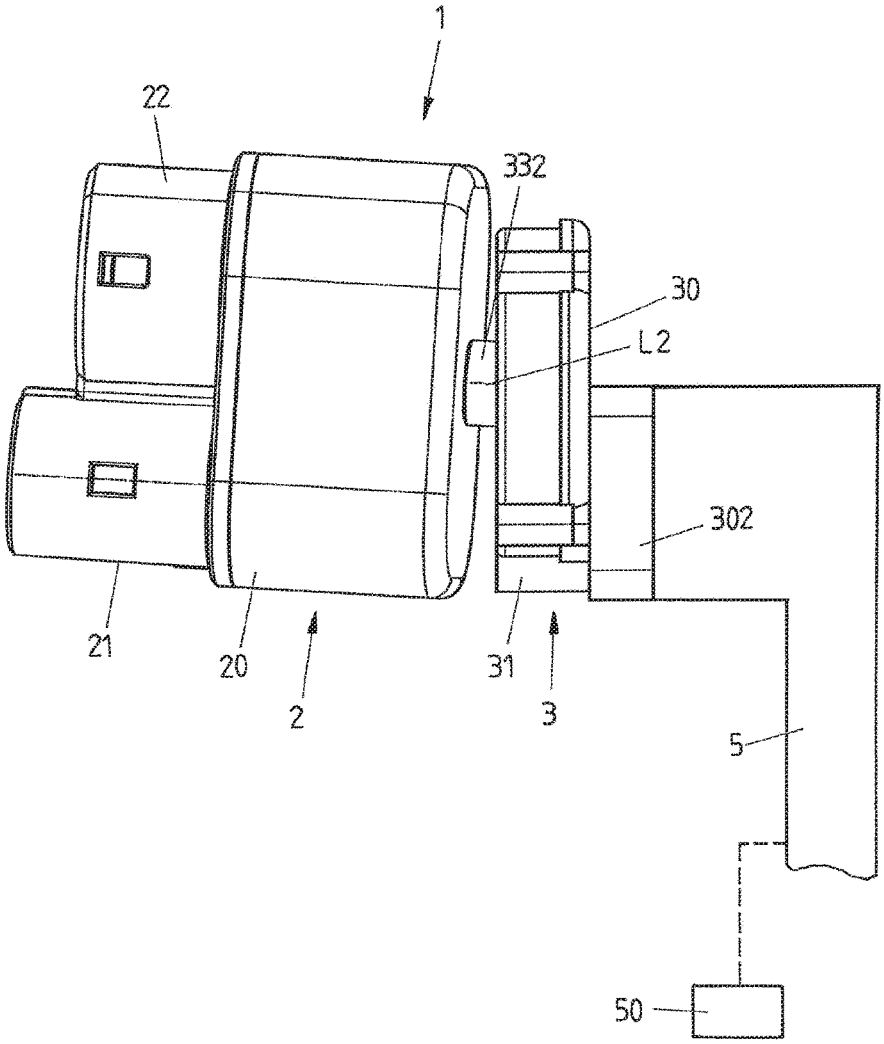
FIG. 8 is a view of the plug connector part in cooperation with a holding device for fully automatically or semi-automatically placing the plug connector part on an associated mating plug connector part.

If, as shown in FIG. 7B, the plug connector part 1 is placed on a mating plug connector part 4 for example with automatic guidance by means of a holding device 5, such as is shown in FIG. 8, the spring element 32 is compressed in a direction A counter to the insertion direction E when the plug-in portions 21, 22 of the plug connector part 1 that are arranged on the plug housing 2 are positioned with the mating plug connector part 4, and counter forces sufficient to compress the spring element 32 thus build up. During this compression of the spring element 32, the longitudinal axes L of the carrier element 33 and of the dome 300 are initially (still) flush with one another.

If the plug connector part 1 is not placed on the mating plug connector part 4 in exactly the correct position and at exactly the correct angle, inserting the plug-in portions 21, 22 of the plug connector part 1 into the associated mating plug connector part 4 results in the position of the plug housing 2 being adapted to the position of the (stationary) mating plug connector part 4. This is because insertion into the mating plug connector part 4 is only possible if the plug-in portions 21, 22 of the plug housing 2 are flush with the mating plug connector part 4.

Because the position of the plug housing 2 thus changes during the positioning with the mating plug connector part 4 and adapts to the mating plug connector part 4, the position of the plug housing 2 changes relative to the housing 30, 31 of the compensation device 3, which is held in position by way of the holding device 5. As a result, the plug housing 2 can be displaced laterally relative to the housing 30, 31 in a direction B transverse to the insertion direction E (FIG. 7C) or pivot relative to the housing 30, 31 of the compensation device 3 in directions C, D (FIG. 7D, 7E).

Figure 7C:
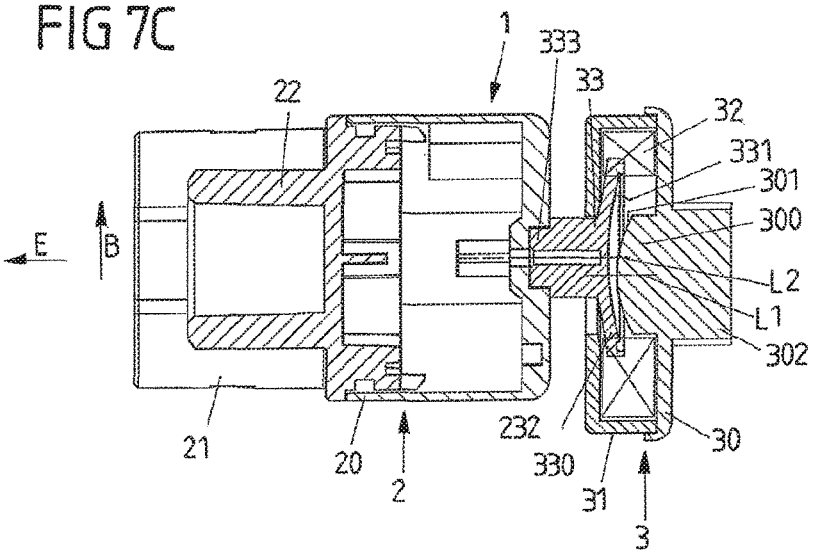
Figure 7D:
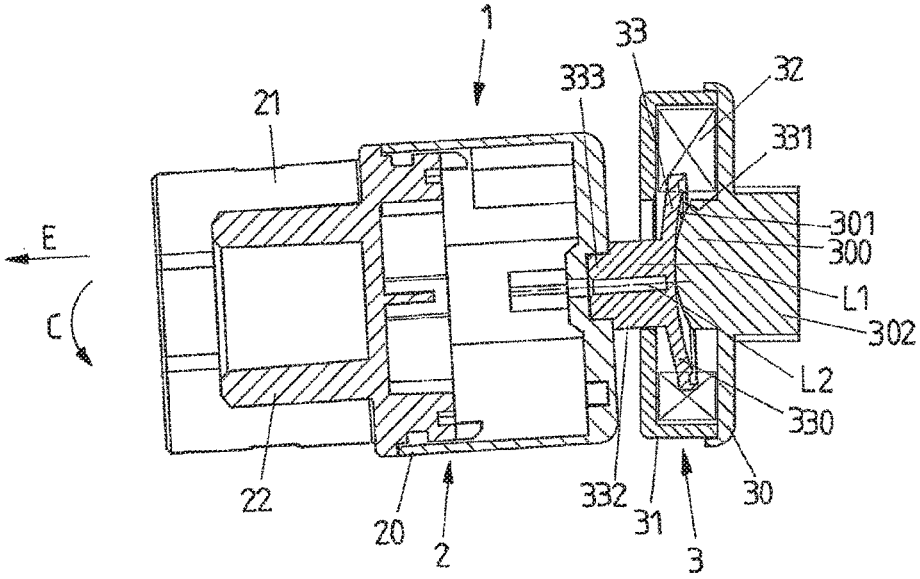
Figure 7E:
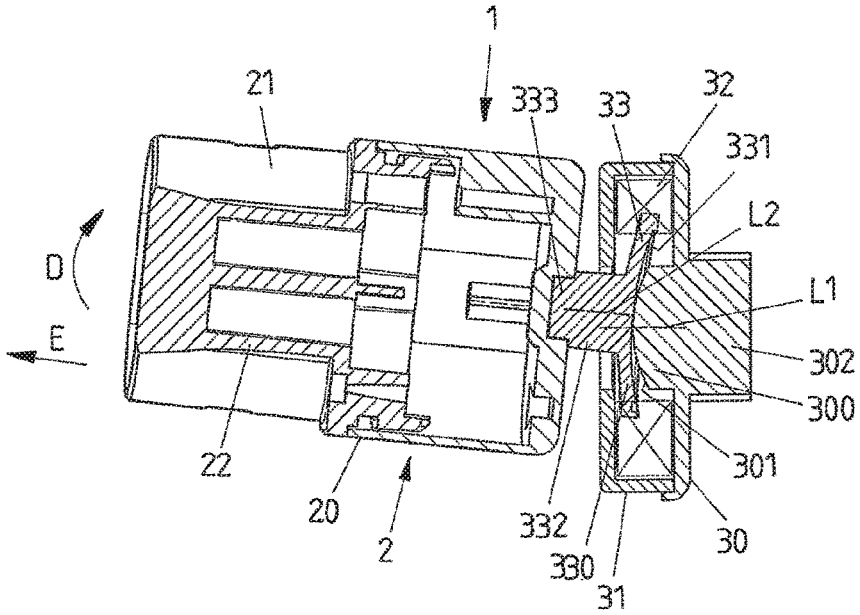

As can be seen from FIG. 7C-7E, during these changes in position of the carrier element 33 in the housing 30, 31, the longitudinal axes L1, L2 of the dome 300 on the one hand and of the carrier element 33 on the other hand are not flush with one another (any longer).

Because when the plug housing 2 is inserted into the associated mating plug connector part 4 compression of the spring element 32 results in the dome 300 contacting the bearing face 31 of the carrier element 33, sufficient plugging forces for plugging the plug housing 2 into the mating plug connector part 4 can be transmitted via the housing 30, 31 of the compensation device 3, on which housing the bearing device 5 acts. This takes place by way of the contact of the contact face 301 of the dome 300 with the bearing face 331 of the carrier element 33.

Because the contact face 301 of the dome 300 on the one hand and the bearing face 331 of the carrier element 33 on the other hand are each formed spherical-cap-shaped, the carrier element 33 can pivot with respect to the dome 300, as is shown in FIG. 7D, 7E. Because the radius R2 of the spherical-cap-shaped bearing face 331 of the carrier element 33 is greater than the radius R1 of the spherical-cap-shaped contact face 301 of the dome 300, this pivoting can take place during a simultaneous lateral change in position of the carrier element 33 relative to the dome 300.

The lateral movement of the carrier element 33 inside the housing 30, 31 is limited by the opening 311, passed through by the stud element 332 of the carrier element 33, in the housing part 31 of the compensation device 3. This is shown by way of example in FIG. 7C and 7D. At maximum deflection, the stud element 332 comes into contact with the rim of the opening 311, in such a way that the lateral adjustability of the carrier element 33 in the housing 30, 31 is limited.

If the plug housing 2 is pulled out of engagement with the mating plug connector part 4 again counter to the insertion direction E, tensile forces can be introduced into the housing 30, 31. As a result, the carrier element 33 comes into contact with the housing part 31 and is pressed against said housing part 31, in such a way that the tensile forces are thereby introduced into the carrier element 33 and transmitted to the plug housing 2. The plug connector part 1 can thus reliably be removed from the mating plug connector part 4.

In principle, rotation of the plug housing 2 about the insertion direction E can also be compensated. This takes place with rotational deformation of the spring element 32, which is both held rotationally engaged in the housing 30, 31 and connected so as to be rotationally engaged with the carrier element 33, and which is thus subjected to torsion during rotational straining of the plug housing 2.

The change in position of the carrier element 33 relative to the housing 30, 31 always takes place by way of deformation of the spring element 32. If there is not (any longer) a strain between the plug housing 2 and the compensation device 3, the spring element 32 relaxes and the carrier element 33 is returned to the initial position thereof (FIG. 7A) inside the housing 30, 31.

FIG. 8 schematically shows a holding device 5, which is connected to a housing 30, 31 of the compensation device 3 via a connecting element 302 and which serves to place the plug connector part 1 on an associated mating plug connector part 4 semi-automatically or fully automatically. The holding device 5 may for example be controlled by way of a suitable control device 50, it being possible for the position of the mating plug connector part 4 to be detected for example by way of sensors, for example using optical sensors, so as to bring the plug connector part 1 toward the mating plug connector part 4 automatically and to bring it into engagement with the mating plug connector part 4.

In the embodiments described above, one or more electrical lines may be guided for example out of the housing 2 in that they exit the housing 2 laterally or upward or downward and are laid away from the housing 2, optionally around the compensation device 3. A plurality of lines may also exit the housing 2 at different faces.

The idea behind the invention is not limited to the embodiments described above, but can also in principle be implemented in a completely different manner.

Thus, in particular, the invention is not limited to use in charging plugs at charging stations or other charging devices, but can be used completely generally in plug connectors.

By way of the described compensation device, positional compensation becomes possible when a plug connector part is placed on an associated mating plug connector part, using only a few components. The compensation device can be of a simple and cost-effective construction, makes it possible to place a plug connector part on a mating plug connector part securely and reliably, and can advantageously provide compensation of positional deviations of a plug connector part when it is placed on a mating plug connector part.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Plug connector part
2 Plug housing
20 Housing portion
21, 22 Plug-in portion
210, 220 Contact elements
3 Compensation device
30 Housing part
300 Dome
301 Contact face
302 Connecting element
31 Housing part
310 Interior
311 Opening
32 Resilient element
320 Receiving portion
321-324 Spring portion
325 Positive-fit element
326 Recess
33 Carrier element
330 Base portion
331 Bearing face
332 Stud element
333 Connecting portion
334 Positive-fit element
4 Mating plug connector part
40 Insertion opening
5 Holding device
50 Control device
A-D Direction
E Insertion direction
L, L1, L2 Longitudinal axis
R1, R2 Radius

The invention claimed is:

1. A plug connector part, comprising:

a plug housing that has at least one plug-in portion configured to be connected to a mating plug connector part by plugging in an insertion direction so as to contact the plug connector part electrically with the mating plug connector part; and a compensation device arranged on the plug housing, the compensation device comprising:

a housing;

a carrier element connected to the plug housing and arranged on the housing; and a spring element that biases the carrier element with respect to the housing, wherein the carrier element is movable relative to the housing by way of resilient deformation of the spring element, wherein a base portion of the carrier element is enclosed in an interior of the housing, wherein the carrier element comprises a stud element, the stud element being arranged on the base portion and passing through an opening in the housing, and wherein the stud element is movable in the opening transverse to the insertion direction.

2. The plug connector part according to claim 1, wherein the carrier element is fixed rotationally engaged on the spring element.

3. The plug connector part according to claim 1, wherein the housing comprises, on a housing part, a dome that protrudes in the insertion direction and that is configured to be brought into contact with a bearing face of the carrier element by way of resilient deformation of the spring element for force transmission in the insertion direction from the housing to the carrier element.

4. The plug connector part according to claim 3, wherein the dome comprises a spherical-cap-shaped contact face.

5. The plug connector part according to claim 4, wherein the bearing face of the carrier element is in the shape of a spherical cap.

6. The plug connector part according to claim 5, wherein the spherical-cap-shaped contact face of the dome has a smaller radius than the spherical-cap-shaped bearing face of the carrier element.

7. The plug connector part according to claim 1, wherein the spring element comprises elastomer.

8. The plug connector part according to claim 1, wherein the spring element biases the carrier element counter to the insertion direction and transverse to the insertion direction with respect to the housing.

9. The plug connector part according to claim 1, wherein the spring element comprises a receiving portion configured to receive the carrier element in a positive fit.

10. The plug connector part according to claim 9, wherein the spring element comprises a plurality of spring portions protruding from the receiving portion axially along the insertion direction and/or radially with respect to the insertion direction.

11. The plug connector part according to claim 10, wherein the spring portions extend annularly around the insertion direction.

12. The plug connector part according to claim 10, wherein the spring portions are interrupted in the peripheral direction around the insertion direction.

13. The plug connector part according to claim 1, wherein the housing of the compensation device is configured to be connected to a holding device for automatically positioning the plug connector part.

14. A plug connector part, comprising:

a plug housing that has at least one plug-in portion configured to be connected to a mating plug connector part by plugging in an insertion direction so as to contact the plug connector part electrically with the mating plug connector part; and a compensation device arranged on the plug housing, the compensation device comprising:

a housing;

a carrier element connected to the plug housing and arranged on the housing; and a spring element that biases the carrier element with respect to the housing, wherein the carrier element is movable relative to the housing by way of resilient deformation of the spring element, and wherein the housing comprises, on a housing part, a dome that protrudes in the insertion direction and that is configured to be brought into contact with a bearing face of the carrier element by way of resilient deformation of the spring element for force transmission in the insertion direction from the housing to the carrier element.

15. The plug connector part according to claim 14, wherein the dome comprises a spherical-cap-shaped contact face.

16. The plug connector part according to claim 15, wherein the bearing face of the carrier element is in the shape of a spherical cap.

17. A plug connector part, comprising:

a plug housing that has at least one plug-in portion configured to be connected to a mating plug connector part by plugging in an insertion direction so as to contact the plug connector part electrically with the mating plug connector part; and a compensation device arranged on the plug housing, the compensation device comprising:

a housing;

a carrier element connected to the plug housing and arranged on the housing; and a spring element that biases the carrier element with respect to the housing, wherein the carrier element is movable relative to the housing by way of resilient deformation of the spring element, wherein the spring element comprises a receiving portion configured to receive the carrier element in a positive fit, and wherein the spring element comprises a plurality of spring portions protruding from the receiving portion axially along the insertion direction and/or radially with respect to the insertion direction.

* * * * *